United States Patent [19]

Dobner et al.

[11] Patent Number: 4,805,544

[45] Date of Patent: Feb. 21, 1989

[54] SEWING MACHINE WITH THREAD MONITOR FOR THE BOBBIN THREAD

[75] Inventors: Reinhold Dobner; Bernhard Mertel; Erich Willenbacher, all of Kaiserslautern, Fed. Rep. of Germany

[73] Assignee: Pfaff Industriemaschinen GmbH, Fed. Rep. of Germany

[21] Appl. No.: 151,471

[22] Filed: Feb. 2, 1988

[30] Foreign Application Priority Data

Feb. 7, 1987 [DE] Fed. Rep. of Germany ..... 8701858

[51] Int. Cl.[4] ..... D05B 45/00

[52] U.S. Cl. ..... 112/278; 112/231; 112/273

[58] Field of Search ..... 112/278, 273, 277, 279, 112/228, 231; 242/37 R

[56] References Cited

U.S. PATENT DOCUMENTS 4,693,196 9/1987 Hager ..... 112/273
4,732,098 3/1988 Mertel et al. ..... 112/278

FOREIGN PATENT DOCUMENTS 3447138 7/1986 Fed. Rep. of Germany ..... 112/278
0185293 8/1986 Japan ..... 112/278

*Primary Examiner*—Peter Nerbun
*Attorney, Agent, or Firm*—McGlew and Tuttle

[57] ABSTRACT

A sewing machine having a thread monitor associated with a bobbin mounted for rotation. The bobbin includes first and second reflecting surfaces associated with an inner side of a second bobbin flange, and first and second light outlet openings associated with a second bobbin flange. A light source is provided for directing light toward the reflecting surfaces. A light receiver is positioned so as to receive light emerging from the first and second outlet opening. The light receiver produces signals representing the light intensity received by the light receiver. A Schmitt trigger provides a pulse to a microprocessor coinciding with a revolution of the bobbin. For each revolution of the bobbin, an A/D converter converts signals received from the light receiver into digital signals which are compared. The digital signal having the maximum value for the revolution is stored in a memory and then compared with a subsequent maximum value. When the subsequent maximum value differs from the stored maximum value, a warning signal is generated by the microprocessor.

13 Claims, 3 Drawing Sheets

Fig. 4a
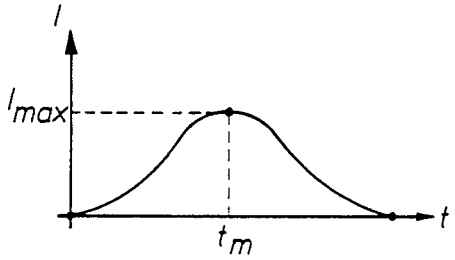
Fig. 4b
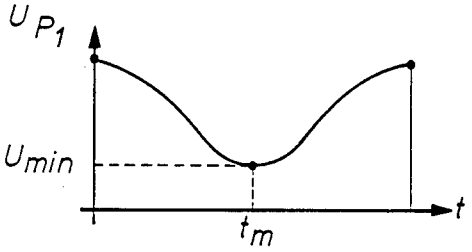
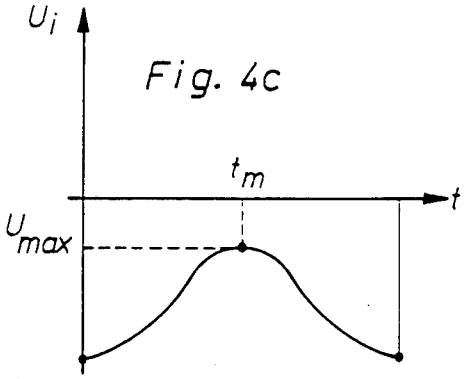
Fig. 4c
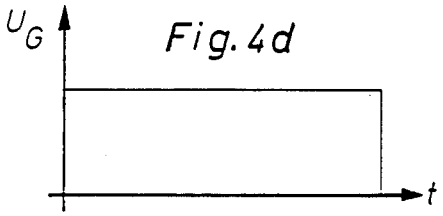
Fig. 4d
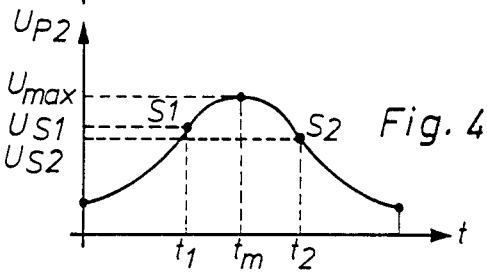
Fig. 4e
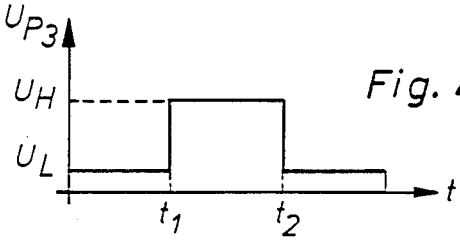
Fig. 4f

SEWING MACHINE WITH THREAD MONITOR FOR THE BOBBIN THREAD

FIELD AND BACKGROUND OF THE INVENTION

The invention relates to a sewing machine with a stop motion for bobbin thread.

U.S. Pat. No. 4,188,902 discloses a sewing machine having a thread monitor with a light source and a light receiver arranged on the back of a shuttle. The loop taking body as well as a bobbin case received therein and a bobbin flange turned toward the thread monitor, the flange having an opening for the entrance and exit of control light rays, while the other bobbin flange bears a reflection surface. On the outer side of the loop taking body a second reflection surface, furnishing reference light rays, is applied. The light rays emitted by the light source are distributed by mirrors over the two reflection surfaces or respectively are collected after reflection and supplied to the light receiver shifted in time. The light receiver is connected to a control circuit by which the intensity of the signals formed from the control rays and from the reference rays is compared. As soon as the control rays reach a predeterminable intensity, the control circuit sends a warning signal announcing the end of the thread.

This setup, however, requires the adaptation both of the loop taking body and of the bobbin case as well as of the bobbin to the mode of operation of the thread monitor. In particular, the adaptation of the loop taking body is of great disadvantage if the thread monitor is retrofitted, as the changing of the loop taker body requires adjustment of the sewing machine.

German utility model No. 85 16 211 discloses a loop taker controllable by an opoelectronically thread monitor. For the entrance and exit of light rays separate inlet and outlet openings are provided in the bobbin case and in one of the bobbin flanges. The other bobbing flange is made to be reflecting. The outlet opening of the bobbin is machined in the truncated coneshaped bobbin hub and is relatively small.

Owing to this, the reflected rays can issue only after even the last layer of thread has been partially unwound. The quantity of residual thread is thus determinable with relative precision, but the arrangement operates with one signal only, the absolute magnitude of which must be picked up exactly.

SUMMARY AND OBJECT OF THE INVENTION

It is the object of the invention to form parts of a rotary hook or loop taker for a sewing machine with a thread monitor in such a way that with inessential structural changes a predeterminable quantity of residual thread can be picked up relatively exactly.

According to the invention, the outlet openings have cross sections of different size and possibly different cross-sectional forms, the light rays issue as a function of their dimensions and arrangement in the bobbin flange, depending on the degree of filling of the bobbin, through one outlet opening only. For example, as long as only the larger outlet opening is cleared by the thread, with each revolution of the bobbin a light ray is delivered to the signal comparison circuit. The intensity of this ray changes little as compared with the previous one. If, on the contrary, the bobbin is unwound to the extent that also rays issue from the smaller outlet opening, the light receiver receives per revolution of the bobbin a second ray, arriving offset in time to the first, the intensity of which is several times lower. After receipt of the second ray, a warning signal announcing the end of the thread is given off in a controldependent manner either immediately or after the predeterminable number of additional revolutions of the bobbin.

By the arrangement of both reflection surfaces, or respectively of the inlet and outlet openings associates with them in the bobbin flanges, the loop taker or rotary hook can, in particular if a thread monitor is retrofitted in the machine, be adapted for its additional task at little cost, as it suffices to exchange the bobbin capsule removably disposed in the loop taker body, and the bobbin support therein, for a new bobbin capsule and another bobbin formed according to claim 1.

The centers of the outlet opening formed in the bobbin flange are located, because of the different size thereof, on different diameters of the bobbin flange or at different radial locations from the center of the bobbin flange. The larger outlet opening, for example, extends almost into the outside region of the bobbin flange. Owing to this, with the bobbin still partially filled, light rays emerge whose intensity is relatively great duee to the large dimensions of this outlet opening.

The smaller outlet opening, on the other hand, is cleared for the emergence of light rays only when the bobbin is less full (almost empty). As both outlet openings extend into the bobbin hub, the rays of the larger outlet opening get into the light receiver up to the last revolution of the bobbin and thus are available also after issuance of the rays from the smaller outlet opening, so that the ratio of the two signals can be formed.

The invention also includes an advanvtageous design of the bobbin hub and of the outlet openings formed therein. By arrangement of the smaller outlet opening in the bobbin hub, light rays emerge therefrom only when the last thread layer is partially unwound. This outlet opening is made relatively small, so that rays of low intensity emerge.

The design of the larger outlet opening according to the invention offers manufacturing advantages, in that the tappet slot already present in the bobbin flange and hitherto active only during the filling of the bobbin is used additionally as outlet opening for light rays.

Since the inlet openings according to claim 5 are provided on the same radius around the bobbin axis, one light source is sufficient for guiding the required rays into the bobbin successively without using any special light-dispersing means.

According to the invention, the required time for monitoring the signals received by the microprocessor is reducible to a minimum. The microprocessor starts to monitor the signals, not with the start of the signals but at a later time, when it is activated by a pulse delivered by the Schmitt trigger. The release time of this pulse is dependent upon a limit voltage adjustsable at the Schmitt trigger and of the response of an analogous voltage present at the input of the Schmitt trigger, which voltage triggers a switching process of the Schmitt trigger by exceeding the limit voltage.

According to another feature of the invention, an advantageous form of realization of a microprocessor is provided to end the monitoring of the digital signal just then present without activating the microprocessor by an external switching device. The digital signals are evaluated by the arithmetic unit of the microprocessor only as long as the quantity of the preceding signal value.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which preferred embodiments of the invention is illustrated.

BRIEF DESCRIPTION OF THE DRAWINGS

In the Drawings:

FIG. 4*a* shows diagrams to illustrate the response of the intensity I of the emerged light rays and following associated voltages U versus the time t;

FIG. 4*b* shows voltage $U_{p1}$ at point P1 of FIG. 3;

FIG. 4*c* shows inverted voltage $U_i$;

FIG. 4*d* shows constant d.c. voltage $U_g$;

FIG. 4*e* shows voltage $U_{p2}$ at point P2 of FIG. 3; and

FIG. 4*f* shows voltage $U_{p3}$ at point P3 of FIG. 3.

DESCRIPTION OF PREFERRED EMBODIMENTS

Figure 2:
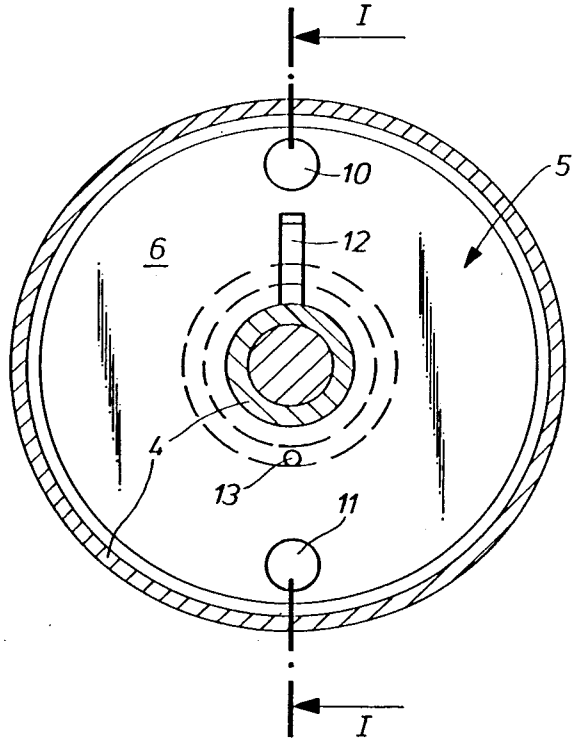
FIG. 2 shows a section along line II—II of FIG. 1.

Referring to the drawing, in particular, the invention embodied therein comprises a sewing machine with a thread monitor 16 including a light source 17 and a light receiver 18 and a double lock stitch loop taker 2 for receiving a bobbin with a reflecting surface **8*b* and 8*a* on the inner side of a bobbin flange 7, the inner side facing toward the light source 17. A first outlet opening 13 is provided associated with one of the reflection surfaces in the bobbin flange 7 to allow for the emergence of reflected light rays which thereby enter the light receiver 18 in time relative to the light rays reflected at a second reflection surface 8*b* also on the inner side of the flange 7. The second oulet opening thereby providing different intensity of light for the formation of a signal of different intensity. The light receiver 18 is connected to a signal comparison circuit 19 to provide a warning signal at a given ratio of the two signals obtained from the light rays reflected. The second reflection surface 8*b* is arranged on the inner side of the bobbin flange 7 which also bears the reflection surface 8*a*. The bobbin flange 6 opposite the bobbin flange 7 is provided with a second outlet opening 12 associated with the second reflection surface 8*b*. The cross-section of the second outlet opening 12 differs from the cross-section of the first outlet opening 13** for the generation of signals.

Figure 1:
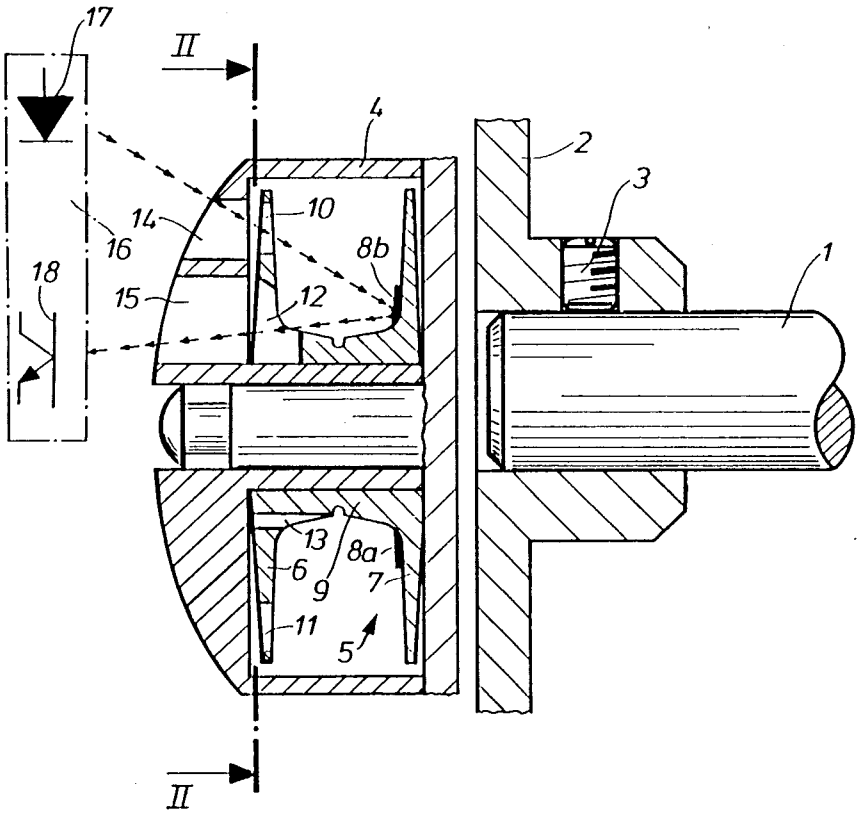
FIG. 1 shows a section through the shuttle of a sewing machine.

The shuttle illustrated in FIG. 1 contains a loop taker or rotary hook drive shaft 1 on which a loop taker or rotary hook body 2, shown only in part, is non-rotationally fastened by a stud 3. In the loop taker body 2, a bobbin case or bobbin capsule 4 is supported in manner not shown. It carries a center pin on which a bobbin 5 wound with thread is rotatably mounted. Bobbin 5 is provided with flanges 6 and 7. The inner side of flange 7 carries a first reflection surface **8*a* and, angularly offset thereto, a second reflection surface 8*b*. The bobbin flanges 6 and 7 are joined together by a bobbin hub 9 to be placed on the center pin. Hub 9 has the form of a truncated cone, starting from its center toward the connection of the bobbin flanges 6 and 7**, respectively.

In the outer region of bobbin flange 8, two inlet openings 10 and 11 are provided offset by 180° in each instance. Associated with the inlet opening 10 is an outlet opening formed by a tappet slot 12, and with the inlet opening 11 an outlet opening in the form of a bore 13. Bore 13 extends, starting from the outer side of flange 6, substantially parallel to the bobbin axis. The exit point of bore 13 is located in the truncated cone-shape bobbin hub 9. Bore 13 is several times smaller than the tappet slot 12. Tappet slot 12 is associated with the reflection surface **8*b*, bore 13 with the reflection surface 8*a***.

The bobbin case 4 has an inlet opening 14 to which a large rectangular outlet opening 15 is associated. In certain positions of the bobbin 5, the inlet opening 14 is aligned with one of the inlet openings 10, 11, while the outlet opening 15 is aligned with the tappet slot 12 or with bore 13. The openings of the bobbin capsule 4 are larger than those of the bobbin 5, to facilitate free passage of the light rays.

On the front of the shuttle, a thread monitor 16 with a light emitting diode 17 and a photo detector 18 designed as photo transistor is arranged. The light emitting diode 17 and the photo detector 18 are symbolized using a schematic representation in FIGS. 1 and 3.

Figure 3:
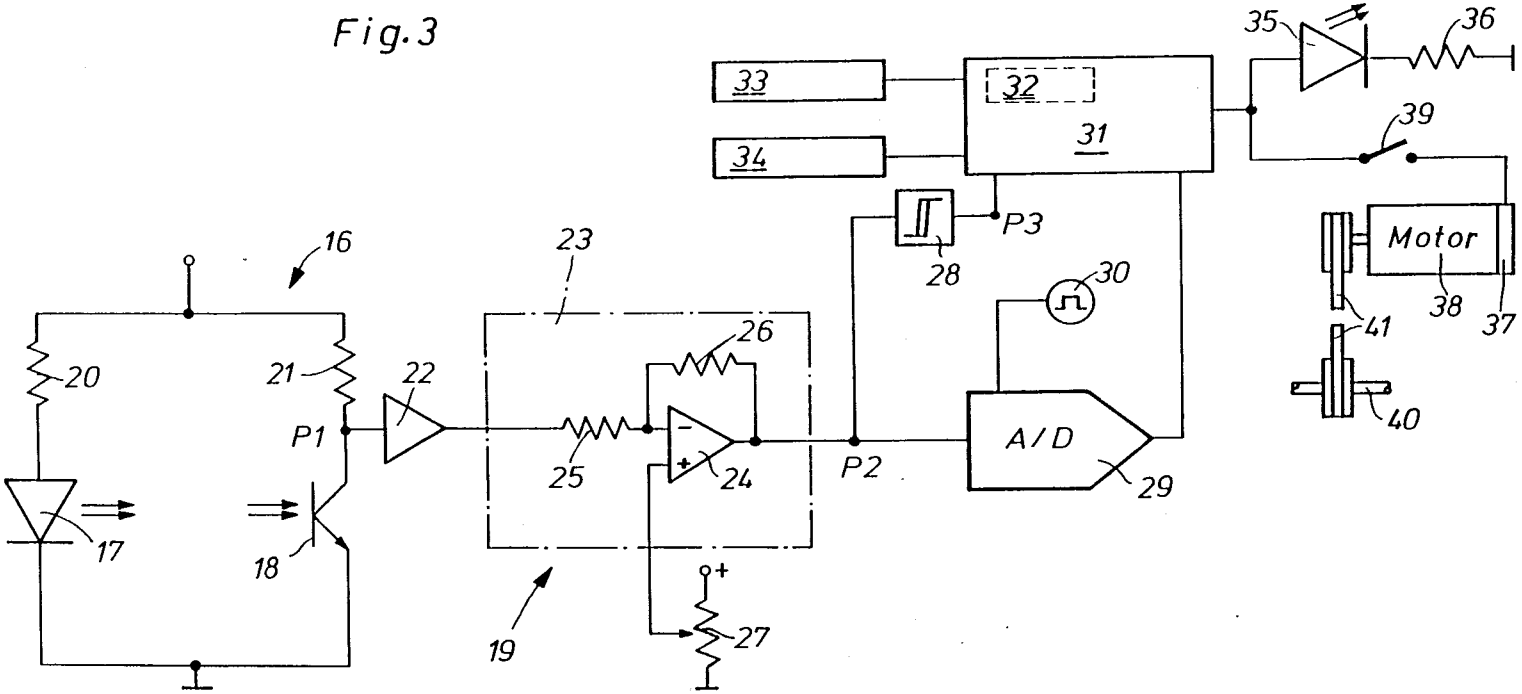
FIG. 3 shows a simplified signal comparison circuit.

FIG. 3 shows in a simplified circuit diagram the components required for the operation of a signal comparison circuit 19. From the positive pole of a controlled voltage source current flows via a resistor 20 and the light emitting diode 17 to ground. In like manner, current flows from the positive pole of the voltage source via a resistor 21 and the photo detector 18 to ground.

Connected to the collector of the photo detector 18 is an amplifier 22, which is connected to an inverting amplifier 23. The inverting amplifier 23 has an operational amplifier 24 which is wired at its inverting input to an input resistor 25 and to a feedback resistor 26. The ratio of feedback resistor 26 to input resistor 25 indicates the gain of the operational amplifier 24, the non-inverting input of which is connected to a potentiometer or variable resistor 27. The potentiometer 27 is inserted between the positive pole of a controlled voltage source and ground.

At the output of the inverting amplifier 23, a Schmitt trigger 28 and an A/D converter 29 are connected in parallel. Connected to the A/D converter 29 is a known clock generator 30. The outputs of the Schmitt trigger 28 and of the A/D are connected to a microprocessor 31 comprising an arithmetic unit 32. Connected to the microprocessor 32 are memories 33 and 34. At a further output of the micoprocessor 31 a display element 35 is connected, which is grounded via a resistor 36. In parallel to the display element 35 is connected at this output of the microprocessor 31 a switch 39 connected to the turnoff device 37 of a drive motor 38. The drive motor 38 drives a main shaft 40 of the sewing machine via a V-belt 41.

The arrangement operates as follows:

When the sewing machine is in operation, light rays emitted by the light diode 17 pass through the inlet openings 14 and 10 of the bobbin capsule 4 and bobbin flange 6 and impinge on the reflection surface **8*b* of bobbin flange 7. With the bobbin 5 rotated forward by 180°, the light rays again fall through the inlet opening 14 of capsule 4, but they pass through the inlet opening 11 to the rflection surface 8*a* of bobbin flange 7**.

As soon as the thread of bobbin 5 has been used up to the extent that a part of the rays reflected at the reflection surface **8*b* can pass the tappet slot 12, rays impinge on the photodetector 18. The intensity curve of such a ray is indicated in FIG. 4***a*, the intensity maximum I max occurring when the openings of capsule 4 and of bobbin 5 are exactly aligned.

The photo detector 18 starts to conduct when it receives light rays, and current flows via resistor 21 to ground. Voltage builds up at resistor 21, owing to which the voltage $U_{p1}$ present at photo detector 18 increases and reaches its minmum U min when the intensity of the light signal is maximum. The response of this voltage is illustrated in FIG. 4*b*.

The voltage $U_{p1}$ is to be transformed in such a way that its curve corresponds to the intensity curve of the light signal. For this reason, the inverting amplifier 23 is connected, by which the voltage $U_{p1}$ is inverted and assumes the shape illustrtated in FIG. 4*c*. Superposed on this voltage is a constant d-c voltage (FIG. 4*d*), the quantity of which is adjustable at the potentiometer 27. The resulting voltage curve of the voltage $U_{p2}$ leaving the inverting amplifier 23 is shown in FIG. 4*e*. This voltage is supplied to the Schmitt trigger 28 and to the A/D converter 29.

The Schmitt trigger 28 transforms the voltage into a square voltage, the shape of which is illustrated in FIG. 4*f*. The respective swiching points S1 and S2 in FIG. 4*e* are adjustable at the Schmitt trigger 28 and determine the time interval $t_{2-t1}$ in which the higher voltage value $U_H$ of the square voltage is present before the lower voltage value $U_L$ is assumed again. The voltage jump from $U_L$ to $U_H$ in the form of a pulse triggers in the microprocessor 31 a program interruption and the start of an interrupt routine.

By the interrupt routine the microprocessor 31 is caused to monitor digital signals present at the output of the A/D converter 29. To this end, the analogous voltage $U_{p2}$ present at the input of the A/D converter 29 is, starting from point S1 in FIG. 4*e*, transformed into digital signals by the A/D converter 29 and relayed to the microprocessor 31. The latter correlates each newly received signal in the arithmetic unit 33 and is returned into the microprocessor 31 to form the correlation. As soon as a subsequent signal is smaller as to quantity than the preceding one, the microprocessor 31 ends the monitoring, stops the interrupt routine, and continues the normal program sequence. By this measure, the time span for monitoring the voltage values is clearly reduced, as the voltage is to be monitored only in the time interval between $t_1$ and $t_m$ (entered in FIG. 4*e*).

The clock generator 30 activates the A/D converter 29 as a function of the sewing speed, so that voltages received by the A/D converter 29 are always sampled at approximately equal intervals.

The maximum value of each of the digital signals is stored in memory 34. As soon as an additional maximum of a new signal is determined by the microprocessor 32, the preceding maximum is called up from memory 34 and is correlated with the new maximum in the arithmetic unit 32 of the microprocessor 31. As long as only one light ray coming from the tappet slot 12 gets into the photo detector 18 per revolution of the bobbin 5, the ratio of two such values differs little from the factor 1. But if a second light ray issues from bore 13, two rays of different intensity enter the photodetector 18. Thereby, signals with clearly different maxima are introduced into the arithmetic unit 32 of microprocessor 31. The ratio of these values is clearly different from the factor 1.

Depending on the programming of the microprocessor 31, the latter sends out a warning signal upon the first arrival of the smaller maximum either immediately or after a predeterminable number of additional revolutions of bobbin 5. By this warning signal, the display element 35 is turned on, thus indicating to the operator the approaching end of the bobbin thread. At the same time, with switch 39 closed, also the turnoff device 37 is actuated. Depending on the design, the turnoff device 37 can turn off the drive motor for example immediately or prevent its restart after the next stopping process.

When replacing the empty bobbin 5 by a thread-filled one, appropriately an electric signal is delivered to the microprocessor 31, so that the latter turns the display element 35 off and, if desired, releases the drive motor 38.

Appropriately both bobbin flanges 6 and 7 are provided with mutually oriented inlet and outlet openings 10, 11 and 12, 13, respectively, in order that the operation of the stop motion will be ensured in any desired position of insertion of bobbin 5 in capsule 4.

While specific embodiments of the invention have been shown and described in detail to illustrate the application of the principles of the invention, it will be understood that the invention may be embodied otherwise without departing from such principles.

What is claimed is:

1. A sewing machine having a thread monitor comprising: a light source; a light receiving member; a bobbin mounted for rotation, said bobbin having a first flange and a second flange, said second flange having an inner surface facing toward said light source and having a first reflecting surface positioned on the inner side of said second flange, said first flange having an outlet opening associated with said first reflecting surface for the emergence of light rays deflected off the corresponding first reflection surface; a second reflection surface positioned on said second flange facing said light source spaced circumferentially from said first reflecting surface; a second outlet opening in said first flange, said second outlet opening being associated with the second reflection surface for the emergence of light rays reflected off the second reflection surface; and, comparison circuit means for receiving a signal from said light receiver and producing a warning signal based on a given ratio of signals obtained from the light receiver corresponding to signals obtained from light rays corresponding to the emergence of light rays from the first outlet opening and the second outlet opening.

2. A sewing machine according to claim 1, wherein: said bobbin includes a central bobbin hub, said outlet openings each extending into the bobbin hub.

3. A sewing machine according to claim 1, wherein: said bobbin includes a central bobbin hub having a truncated coneshaped region, said smaller second opening running said cone-shaped region and extending substantially parallel to the axis of said bobbon hub, the larger first outlet opening forming a cut-out in the bobbin hub.

4. A sewing machine according to claim 1, wherein: the larger first outlet opening is formed by a tappet slot.

5. A sewing machine according to claim 1, wherein: said first bobbin flange has two inlet openings for the entrance of several successive light rays, one of the two inlet openings being associated with said first outlet opening, and the other inlet opening being associated with said second opening.

6. A sewing machine according to claim 1, wherein: said signal comparison circuit means includes an A/D converter converting analog signals representing light intensity to digital signals and a microprocessor for evaluating only a predeterminable portion of the digital signals delivered by the A/D converter.

7. A sewing machine according to claim 1, wherein: said comparison circuit comprises an A/D converter for receiving analog signals representing light received by said light receiver and forming digital signals, a microprocessor adapted to receive said digital signals; and, a Schmitt trigger for receiving an analog signal representing the light intensity at said light receiver and forming a pulse, said Schmitt trigger being connected to said microprocessor to trigger said microprocessor.

8. A sewing machine according to claim 7, wherein: said microprocessor includes an arithmetic unit means for correlating a digital signal value with a preceding digital signal value, the preceding digital signal value being temporarily stored in a memory.

9. A sewing machine with a bobbin thread monitor comprising: a light source for emitting light rays; a light receiver for receiving light rays and generating a signal corresponding to the intensity of the light rays received; a bobbin having a first flange, a second flange and a central hub, said bobbin being mounted for rotation about said central hub, said bobbin second flange having a first light-reflecting surface on an inner side facing said light source and having a second light reflecting surface on an inner side facing said light source and spaced circumferentially from said first light-reflecting surface, said first flange having a first light outlet opening substantially aligned with said first light reflecting surface for emergence of reflected light rays and a second light outlet opening substantially aligned with said second light reflecting surface for emergence of reflected light rays, reflected light rays emerging from said first light outlet opening impinging on said light receiver when said first outlet opening is substantially aligned with said light-receiver upon rotation of said bobbin, deflected light rays emerging from said second outlet opening impinging on said light receiver when said second outlet opening is substantially aligned with said light receiver upon rotation of said bobbin, said first outlet opening having a cross-section which differs from said second outlet opening; and, signal comparison circuit means connected to said light receiver for receiving signals representing light rays of different intensity and delivering a warning signal at a given ratio of the received signals.

10. A sewing machine according to claim 9, wherein: each of said outlet openings are formed in said hub and said first flange.

11. A sewing machine according to claim 9, wherein: said second outlet opening has a cross-section smaller than said first outlet opening and extends substantially parallel to said central hub, said hub having a truncated cone-shaped region opening into said second outlet opening, said first outlet opening forming a cut-out in said hub.

12. A sewing machine according to claim 9, wherein: said first bobbin flange includes a first light inlet opening associated with said first reflecting surface and a second light inlet opening associated with said second light reflecting surface.

13. A sewing machine according to claim 9, wherein: said signal comparison circuit means includes an A/D converter receiving signals representing light rays of different intensity and delivering digital signals representing light rays of different intensity; pulse generator means for receiving signals representing light rays of different intensity and delivering a pulse signal substantially corresponding to the intensity of light rays when one of said first and second outlet openings are aligned with said first light receiver; a first memory means for storage of a digital signal; a second memory means for storage of a digital signal; a microprocessor connected to said pulse generator and connected to said A/D converter, said A/D converter, said microprocessor being triggered by said pulse to monitor the output of said A/D converter from the time the pulse is received until the value of the signal received from the A/D converter is smaller than the preceding value of the signal received, said microprocessor storing the signal representing the maximum value of the signal received from the A/D converter during said monitoring, said microprocessor including an arithmetic means to compare each new maximum signal received during monitoring to the maximum signal stored in the memory; when said signals differ, said microprocessor sends out a warning signal.

* * * * *